United States Patent [19]

Tamba et al.

[11] Patent Number: 4,738,306

[45] Date of Patent: Apr. 19, 1988

[54] HORIZONTAL TYPE RADIATOR FOR ENGINES

[75] Inventors: Shinichi Tamba, Kakogawa; Hitomi Miyake, Kobe, both of Japan

[73] Assignee: Kawasaki Jukogyo Kabushiki Kaisha, Kobe, Japan

[21] Appl. No.: 1,158

[22] Filed: Jan. 7, 1987

[30] Foreign Application Priority Data

Jan. 13, 1986 [JP] Japan ..... 61-3619[U]

[51] Int. Cl.[4] ..... F28F 9/02

[52] U.S. Cl. ..... 165/173; 165/178; 165/71; 165/917; 123/41.54

[58] Field of Search ..... 165/173, 178, 71, 917; 123/41.51, 41.54

[56] References Cited

U.S. PATENT DOCUMENTS 3,750,744 8/1973 Bouzas ..... 165/178 X
4,360,060 11/1982 Collgon ..... 165/173
4,456,059 6/1984 Cadars ..... 165/173

FOREIGN PATENT DOCUMENTS 56-56595 5/1981 Japan ..... 165/173

*Primary Examiner*—Albert W. Davis, Jr.
*Assistant Examiner*—Richard R. Cole

[57] ABSTRACT

An improved horizontal type radiator is disclosed in which the top wall of a header tank, into which a bank of radiator tubes are opened, is externally raised into an annular bulge formed to encircle an upper pipe hole bored in the wall through which a water filling pipe is inserted into the header tank forming an annular space about the inserted lower end of the pipe. Also, the bottom wall of the header tank is outwardly bulged into an annular bulge formed to encircle a lower pipe hole bored in the wall through which a water passage pipe is inserted into the header tank forming an annular space about the inserted end portion of the water passage pipe. With this arrangement, in operation when the water flows from the radiator tubes into the header tank, the water has limited chance of entraining air within the header tank, since the upper annular space in which air may possibly be entrained offers only a minimum contact surface of air with the water. Thus, deterioration of performance, abnormal noise and vibration in the system as can be brought about by the entrance of air can be obviated. Furthermore, when the radiator has to be emptied for maintenance or storage, almost all the inside water can be expelled, except for a very little amount that might be left undrained within the small lower annular space. Thus, long-term storage of a radiator is possible, without corrosion.

6 Claims, 2 Drawing Sheets

HORIZONTAL TYPE RADIATOR FOR ENGINES

BACKGROUND OF THE INVENTION (1) Field of the Invention

This invention relates in general to a radiator for internal combustion engines and, in more particular, to a horizontal type radiator in which a bank of flat radiating tubes are horizontally disposed between a pair of opposite header tanks.

(2) Description of the Prior Art

There have been various types of horizontal type radiators developed for internal combustion engines. One representative such radiator, proposed by the inventor of this invention, is illustrated in FIGS. 3 and 4, in which the radiator body, generally designated at 1, comprises a bank of horizontally arranged radiator tubes 8 interposed between a pair of opposite righthand and lefthand end plates 2, although the drawing is showing the leftside one for clarity's sake. A header tank 3 is welded to each of the end plates 2 at a rim part 4 on both sides of the tube assembly 8.

A filling pipe 5 is inserted into a pipe hole 6, generally bored by a burring reamer, in the top wall 3*a* of the header tank 3 to fill the header tanks 3 of the radiator 1. The header tank 3 has its bottom wall 3*b* with a pipe hole 16, generally bored by a burring reamer, into which a water passage pipe 15 is inserted, disposed integrally with the filling pipe 5. The radiator tubes 8 are rigidly supported in the end plates 2, to which they may generally be jointed by welding, and each affixed to the side of the header tank 3 where they are opened into the header tank inside through apertures formed in the header tank side.

The filling pipe 5 has at a lower end thereof an opening 9 to communicate with the header tank inside through the pipe hole 6, and at its opposite end a filling hole 10 closed by a removable cap 11. Also, the water passage pipe 15 has at an upper end thereof an opening to drain the header tank 3 to recirculate the water, now cooled through the radiator tubes 8, through the pipe hole 16 to the cooling jacket via a rubber hose, not shown, connected to the lower end of the water passage pipe.

The radiator 1 receives the heated water from the cooling jacket of the engine through an inlet pipe, not shown, connected to the rightside header tank, not shown.

However, those conventional radiators have been found to have various problems due to their designs that the filling pipe 5 has its lower end portion 12 inserted into the inside of the header tank 3 such that welding provides for development of enough fillet F1 and F2 to insure water proof and pressure tight joint between the pipe hole 6 and filling pipe 5.

Thus, huge amounts of air have been tended to be entrained within the header tanks 3 during operation, just above the horizontal level A in FIG. 3 defined by the bottom edge of the lower filling pipe end portion 12. In operation, as the heated water flows from the radiator tubes 8 in the direction indicated by the arrow B, such entrained air is induced into the water inside the piping. As a result, performance can deteriorated, accompanied with abnormal noise and vibration in the cooling system. In extreme cases, corrosion can result inside the radiators and pipes.

Furthermore, in the prior art, the water passage pipe 15 have their upper end portion 13 inserted into the header tank 3 to provide for adequate formation of fillet F3 by welding enough to insure solid joint between the water passage pipe 15 and pipe hole 16, as in the case of filling pipes 5. Because of this design, greater difficulty has been encountered to drain a radiator 1 as when the engine is disassembled or the radiator is transported or stored for long periods, since some considerable amount of water has tended to be left undrained below the horizontal level C defined by the top edge of the upper pipe end portion 13. Such residual water tended to enter the engine interior, when the radiator 1 was disassembled. In some instances, it spilled unexpectedly smearing the operator's clothing. In addition, such residual water can corrode a radiator's header tanks 3 or radiator tubes 8 during storage.

SUMMARY OF THE INVENTION

The present invention has been proposed to eliminate the above drawbacks of difficulty with the conventional radiators.

It is therefore a primary object of the present invention to provide an improved radiator which reduces the amount of air entrained inside its header tanks so as to protect the radiator tubes and header tank insides from corrosion and hence insure stabilized performance.

Another object of the present invention is to provide such a radiator which obviates the problem of residual water entering the engine interior or spilling onto the operator's clothing as when the radiator assembly is dismounted.

The above and other objects, features and advantages of the present invention are accomplished by a radiator header tank in which the upper and lower walls of the header tank are externally buldged around the pipe holes into which the filling and water passage pipes are inserted, respectively.

DETAILED DESCRIPTION OF PREFERRED EMBODIMENTS

Figure 1:
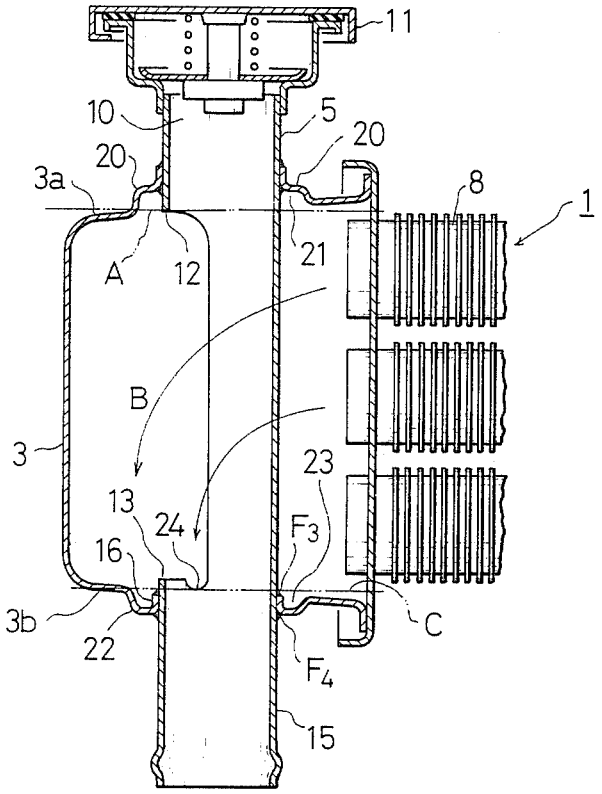
FIG. 1 is a side cross-section view of a preferred embodiment of the horizontal type radiator according to the present invention.

Referring to FIG. 1, which illustrates a side cross-sectional view of a preferred embodiment of the horizontal type radiator according to the present invention, a radiator assembly 1 comprises a bank of radiator tubes 8 interposed between a pair of opposed righthand and lefthand header tanks 3, although only the lefthand one is shown for clarity's sake. Since the radiator tubes 8 are welded to the header tanks at both ends of the radiator tubes 8 through an end plate in the same manner as in conventional radiators, no detailed description is given here as to the structure.

Connected to the header tank 3 is a filling pipe 5 to fill the radiator 1 with water from its upper opening 10 closed by a removable cap 11. The filling pipe 5 is provided at a lower end thereof with an opening 12, for fluid communication with the header tank inside. The filling pipe 5 is inserted into a pipe hole 6, preferably bored by a burring reamer, in the upper wall 3*a* of the header tank 3. The upper wall 3*a* is externally raised into an annular bulge 20 about the pipe hole 6 forming an annular space 21 about the filling pipe 5 over a length thereof following said pipe hole 6 within the header tank 3. The location of the opening 12 in the filling pipe 5 is such that the annular space 21 has its lower end in close vicinity of the opening 12. Because of this arrangement, the inside wall is allowed to rise to the horizontal level A largely defined by the plane of the upper wall 3*a*, well above the top wall of the uppermost radiator tube 8 in the radiator 1. Thus, the radiator 1 admits far more reduced air than any other conventional one, less than or, at most, equal in amount to the volume of the annular space 21 during the operation, thereby minimizing the possibility of abnormal performance and corrosion owing to the entrance of air into the system.

In addition, the bottom wall 3*b* is also externally raised into an annular bulge 22 about the pipe hole 16, which may also preferably be bored by a burring reamer, through which the water passage pipe 15 is inserted into the tank inside, forming an annular space 23 about the water passage pipe 15 over a length thereof following the pipe hole 16. Also, the water passage pipe 15 is provided with an opening 13 for fluid communication within the header tank 3. The location of the opening 13 in the water passage pipe 15 is such that the annular space 23 has its lower end in close vicinity of the opening 13. Also, the water passage pipe 15 is provided with a semi-circular cutout 24 adjacent to its upper opening 13. Thus, when the radiator 1 is drained for storage or maintenance, the residual water that might remain at the bottom of the header tank 3 will be limited to an amount less than or, at most, equal to the volume of the annular space 23.

With the above arrangement, during operation when the water flows from the radiator tubes 8 in the direction indicated by the arrow B in FIG. 1, since the water has a minimum contact surface with the air entrained in the annular space 21, little or no amount of air will be induced into the water. Thus, stable radiator performance can be insured, without causing abnormal noise or vibration in the cooling system.

Moreover, when the radiator 1 has to be emptied for maintenance or storage, almost all the inside water can be drained out, except a very little amount that might remain undrained in the annular space 23 just below the horizontal level C in the header tank 3, so that long-term storage of the radiator is possible without developing corrosion in the header tank or piping. In addition, the maintenance-man will be free from the worry of being dirtied with the residual water spilled from the radiator during the work.

Although, in this embodiment, the filling pipe 5 is formed integrally with the water passage pipe 15 into a single pipe, with their respective openings 12 and 13 merged into an elongate slit axially extending between the annular space 21 and 23, the pipe 5 and 15 may be provided as separate pipes.

Figure 2:
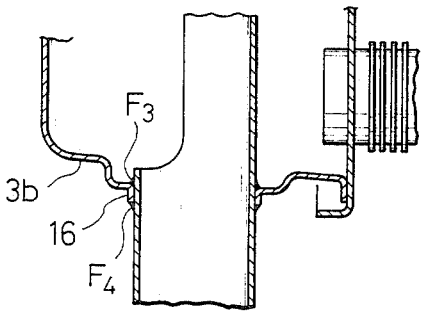
FIG. 2 is an enlarged view of the important part of another preferred embodiment of the radiator according to the present invention.
Figure 3:
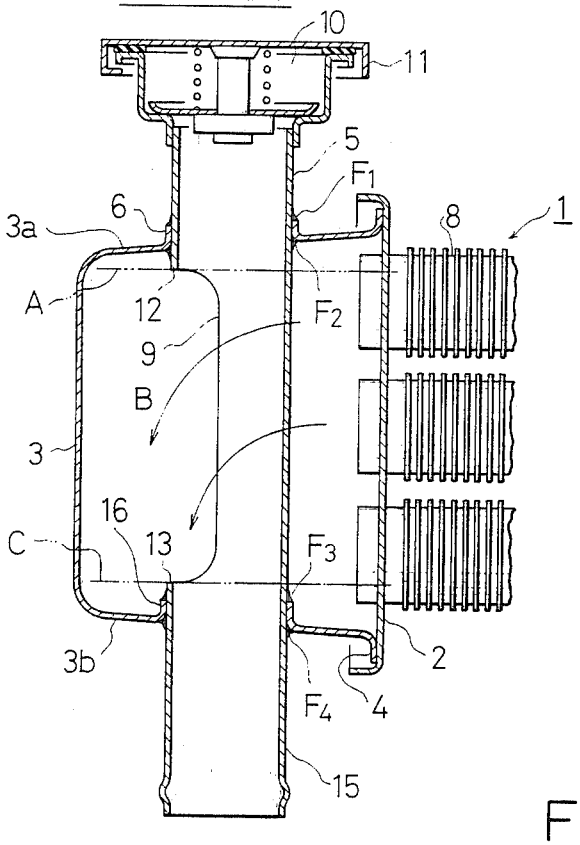
FIG. 3 PRIOR ART
FIG. 3 is a side cross-sectional view of the conventional radiator.
Figure 4:
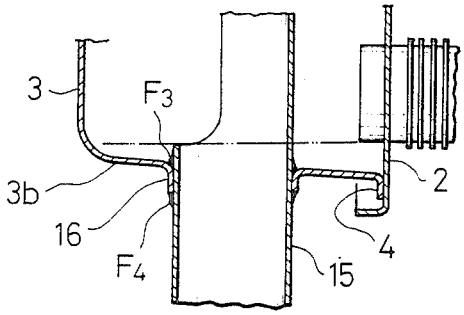
FIG. 4 PRIOR ART
FIG. 4 is an enlarged view of the important part of FIG. 3.

FIG. 2 illustrates another embodiment of the radiator according to the present invention, in which the annular bulge 22 of the bottom wall 3b has its inside periphery externally crimped. The water passage pipe 15 is welded to the inner edge of the bulge 22 in the pipe hole 16, providing for formation of adequate band of fillet F3 about the upper pipe end portion for increased water and pressure tightness. Moreover, this design can eliminate the cutout of the previous embodiment.

It is to be understood that changes and modifications are possible without departing from the spirit of the present invention and that this invention should be limited, not by the above description of particular embodiments and the drawings given by way of illustration, but by the scope of the appended claims.

What is claimed is:

1. In a radiator comprising a header tank having a top wall with pipe hole, a bank of substantially horizontally extending radiator tubes connected to said tank, and a water filling pipe extending substantially vertically into said header tank through said pipe hole, and adapted for connection to an inlet through which said radiator is filled with water, the improvement comprising: said top wall having a portion about said pipe hole which swells outwardly from said tank, and an opening in said water filling pipe for fluid communication with said radiator tubes, said water filling pipe having a lower end which extends downward from within said outwardly swelling portion, said opening being located in said lower end and having an upper edge located between said top wall of said header tank and the top one of said radiator tubes, so that said opening determines the horizontal level of water in said header tank when said radiator is filled with water.

2. A radiator as set forth in claim 1, wherein said top wall has a crimp along an inner periphery of said outwardly swelling portion, and is welded to an outside surface of said water filling pipe along said crimp.

3. In a radiator according to claim 1, a water passage pipe having an end integrally connected to the lower end of said water filling pipe.

4. In radiator comprising a header tank having a bottom wall with a pipe hole, a bank of substantially horizontally extending radiator tubes connected to said tank, and a water passage pipe extending subtantially vertically into said header tank through said pipe hole, the improvement comprising: said bottom wall having a portion about said pipe hole which swells outwardly from said tank, and an opening formed in said water passage pipe for fluid communication with said radiator tubes, said water passage pipe having an upper end which extends upward from with in said outwardly swelling portion, said opening being located in said upper end and having a lower edge located between said bottom wall of said header tank and a bottom one of said radiator tubes so that said opening determines the horizontal level of residual water in said header tank when said radiator is drained.

5. A radiator as set forth in claim 4, wherein said bottom wall has a crimp extending outwardly along an inner periphery of said outwardly swelling portion surrounding said pipe hole, and is welded to an outside surface of said water passage pipe along said crimp.

6. In a radiator according to claim 4, a water filling pipe having an end integrally connected to the upper end of said water passage pipe.

* * * * *